US006997346B2

(12) United States Patent
Landers et al.

(10) Patent No.: US 6,997,346 B2
(45) Date of Patent: Feb. 14, 2006

(54) APPARATUS AND METHOD FOR REDUCING BUILDUP OF PARTICULATE MATTER IN PARTICULATE-MATTER-DELIVERY SYSTEMS

(75) Inventors: Alan Edward Landers, Suwanee, GA (US); John Pressley Beal, Atlanta, GA (US)

(73) Assignee: Process Control Corporation, Atlanta, GA (US)

( * ) Notice: Subject to any disclaimer, the term of this patent is extended or adjusted under 35 U.S.C. 154(b) by 32 days.

(21) Appl. No.: 10/730,477

(22) Filed: Dec. 8, 2003

(65) Prior Publication Data

US 2005/0121469 A1 Jun. 9, 2005

(51) Int. Cl.
*G01F 11/00* (2006.01)

(52) U.S. Cl. ..... 222/1; 222/185.1; 222/413; 222/460

(58) Field of Classification Search ..... 222/185.1, 222/413, 460, 462, 575, 1
See application file for complete search history.

(56) References Cited

U.S. PATENT DOCUMENTS

| | | | | |
|---|---|---|---|---|
| 3,203,599 | A * | 8/1965 | Renner | 222/196 |
| 3,937,192 | A | 2/1976 | Longhouse | 123/41.49 |
| 4,086,847 | A | 5/1978 | Overmyer | 98/115 |
| 4,088,270 | A | 5/1978 | Maiden | 239/265.25 |
| 4,682,506 | A | 7/1987 | Wiench et al. | 73/863.54 |
| 4,958,741 | A | 9/1990 | Johanson | 220/83 |
| 5,016,818 | A | 5/1991 | Nash et al. | 239/127.1 |
| 5,470,439 | A | 11/1995 | Makino et al. | 162/216 |
| 5,645,381 | A | 7/1997 | Guidetti et al. | 406/156 |
| 5,785,880 | A | 7/1998 | Heaslip et al. | 222/594 |
| 5,944,261 | A | 8/1999 | Heaslip et al. | 239/553.5 |
| 6,027,051 | A | 2/2000 | Heaslip et al. | 239/590.5 |
| 6,055,781 | A | 5/2000 | Johanson | 52/197 |
| 6,186,373 | B1 * | 2/2001 | Johanson | 222/413 |
| 6,336,573 | B1 | 1/2002 | Johanson | 222/412 |
| 6,464,154 | B1 | 10/2002 | Heaslip et al. | 239/590.5 |

OTHER PUBLICATIONS

K-Tron Soder "Twin Screw Volumetric Feeder".
K-Tron Soder "Dosiergeräte-Norm K-TRON SODER".
Jenike & Johanson Inc.; Carson et al. "How to Design Efficient and Reliable Feeders for Bulk Solids".

* cited by examiner

*Primary Examiner*—Joseph A. Kaufman
(74) *Attorney, Agent, or Firm*—Thomas, Kayden, Horstemeyer & Risley LLP; Todd Deveau

(57) ABSTRACT

The present disclosure provides approaches for reducing buildup of particulate-matter in particulate-matter-delivery systems. In some embodiments, a trough-shaped feeder is provided in which a rectangular-to-elliptical conduit extends from the trough-shaped feeder. The trough-shaped feeder has a substantially-rectangular feeder opening. The rectangular-to-elliptical conduit has an elliptical end and a rectangular end. The elliptical end of the rectangular-to-elliptical conduit has a substantially-elliptical conduit opening. Interfacing the storage hopper to the trough-shaped feeder via a elliptical-to-rectangular conduit reduces the particulate-matter-delivery system's susceptibility to bridges and rat holes.

28 Claims, 9 Drawing Sheets

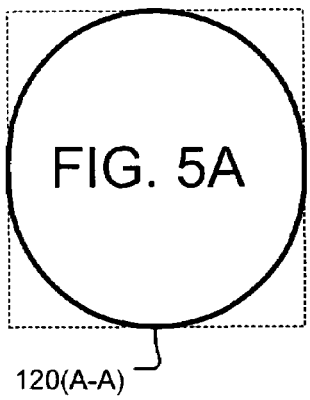
FIG. 5A
120(A-A)
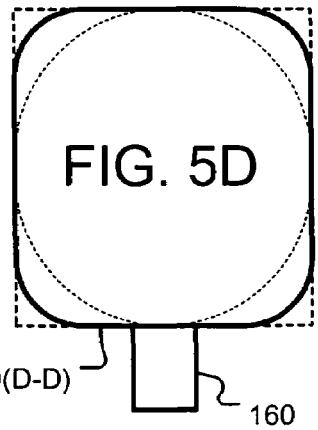
FIG. 5D
120(D-D)
160
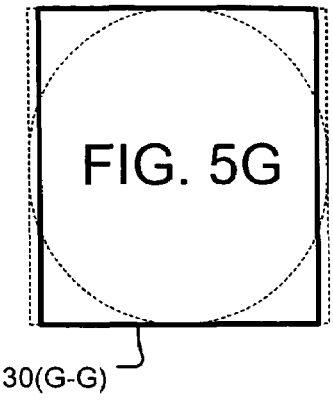
FIG. 5G
130(G-G)
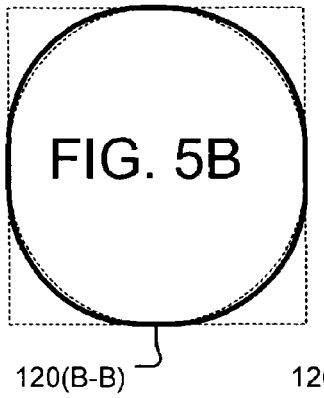
FIG. 5B
120(B-B)
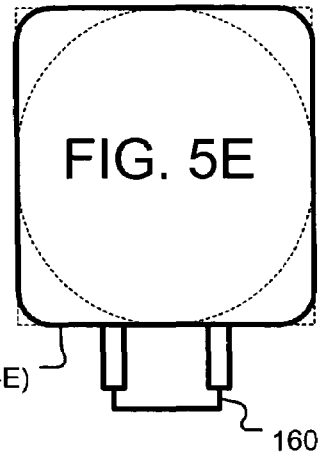
FIG. 5E
120(E-E)
160
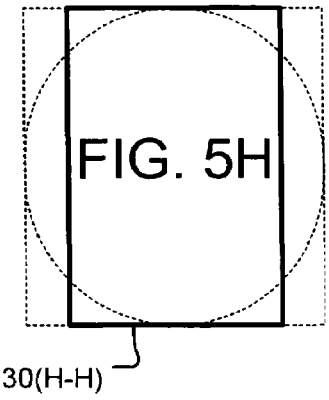
FIG. 5H
130(H-H)
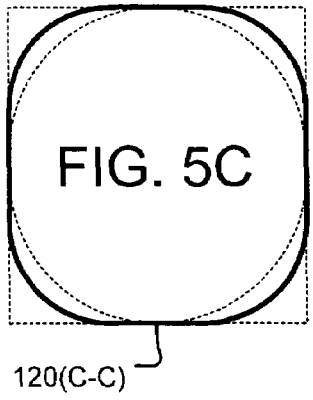
FIG. 5C
120(C-C)
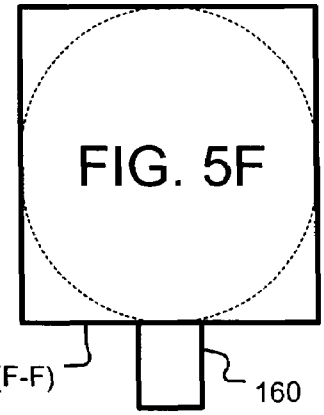
FIG. 5F
120(F-F)
160
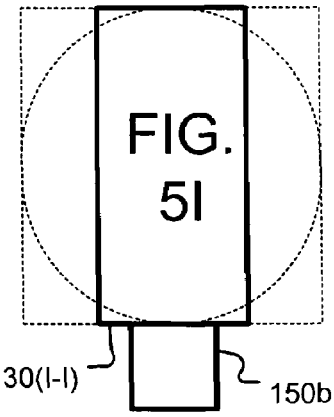
FIG. 5I
130(I-I)
150b
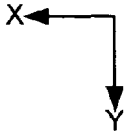
X
Y

APPARATUS AND METHOD FOR REDUCING BUILDUP OF PARTICULATE MATTER IN PARTICULATE-MATTER-DELIVERY SYSTEMS

FIELD OF THE INVENTION

The present disclosure relates generally to delivery of particulate matter and, more particularly, to systems and methods for reducing buildup of particulate-matter in particulate-matter-delivery systems.

BACKGROUND

Particulate-matter-delivery systems often comprise a storage hopper coupled to a bin.

The storage hopper holds particulate matter (e.g., powder, pellets, etc.) and delivers the particulate matter to the bin.

Often, the bins are shaped as troughs with a rectangular opening and semicircular lateral profile. The bins receive the particulate matter from the storage hopper through the rectangular opening. Thus, in order to deliver particulate matter to the rectangular opening, traditional storage hoppers have taken the shape of a rectangular cylinder (i.e., a cylinder having a rectangular axial profile) that matches the rectangular opening of the bin. The rectangular axial profile of the storage hopper inherently includes corners at the intersection of the storage hopper walls. Unfortunately, particulate matter can become lodged in those corners, thereby making the rectangular axial profile susceptible to buildup of particulate matter. The buildup of particulate matter, in turn, can result in the formation of "bridges" or "rat holes."

In an attempt to remedy such problems, storage hoppers having circular axial profiles (i.e., circular cylinders) have been substituted for storage hoppers with rectangular axial profiles. In order to accommodate the circular axial profile of the storage hoppers, bowl-shaped bins with circular openings are substituted for trough-shaped bins. The circular opening of the bowl-shaped bin receives particulate matter from the storage hopper having the circular axial profile. Unfortunately, the bowl-shaped bin provides less exposure to the auger than the trough-shaped bin. The reduced exposure to the auger results in decreased accuracy and consistency in the delivery of particulate matter.

In view of these and other deficiencies, a need exists in the industry.

SUMMARY

The present disclosure provides approaches for reducing buildup of particulate-matter in particulate-matter-delivery systems.

Briefly described, in architecture, one embodiment of the system comprises a trough-shaped feeder and a rectangular-to-elliptical conduit extending from the trough-shaped feeder. The trough-shaped feeder has a substantially-rectangular feeder opening. The rectangular-to-elliptical conduit has an elliptical end and a rectangular end. The elliptical end is opposite the rectangular end. The rectangular end of the conduit is shaped to engage the substantially-rectangular feeder opening. The elliptical end of the rectangular-to-elliptical conduit has a substantially-elliptical conduit opening.

The present disclosure also provides methods for reducing buildup of particulate-matter in particulate-matter-delivery systems. In this regard, one embodiment of the method comprises the steps of interfacing a storage hopper with a trough-shaped feeder using an elliptical-to-rectangular conduit.

Other systems, devices, methods, features, and advantages will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the disclosure can be better understood with reference to the drawings. The components in the drawings are not necessarily to scale, emphasis instead being placed upon clearly illustrating the principles of the present disclosure. Moreover, in the drawings, like reference numerals designate corresponding parts throughout the several views.

FIG. 5A is a diagram showing a circular profile at the top of the conduit as defined by the plane A—A of FIG. 3.

FIGS. 5B, 5C, 5D, and 5E are diagrams showing a circular-to-rectangular transition of the profile of the conduit as defined by the planes B—B, C—C, D—D, and E—E, respectively, of FIG. 3.

FIG. 5F is a diagram showing a rectangular profile at the bottom of the conduit as defined by the plane F—F of FIG. 3.

FIGS. 5G, 5H, and 5I are diagrams showing the transition of the profile in the trough as defined by the planes G—G, H—H, and I—I, respectively, of FIG. 3.

DETAILED DESCRIPTION OF THE EMBODIMENTS

Figure 1:
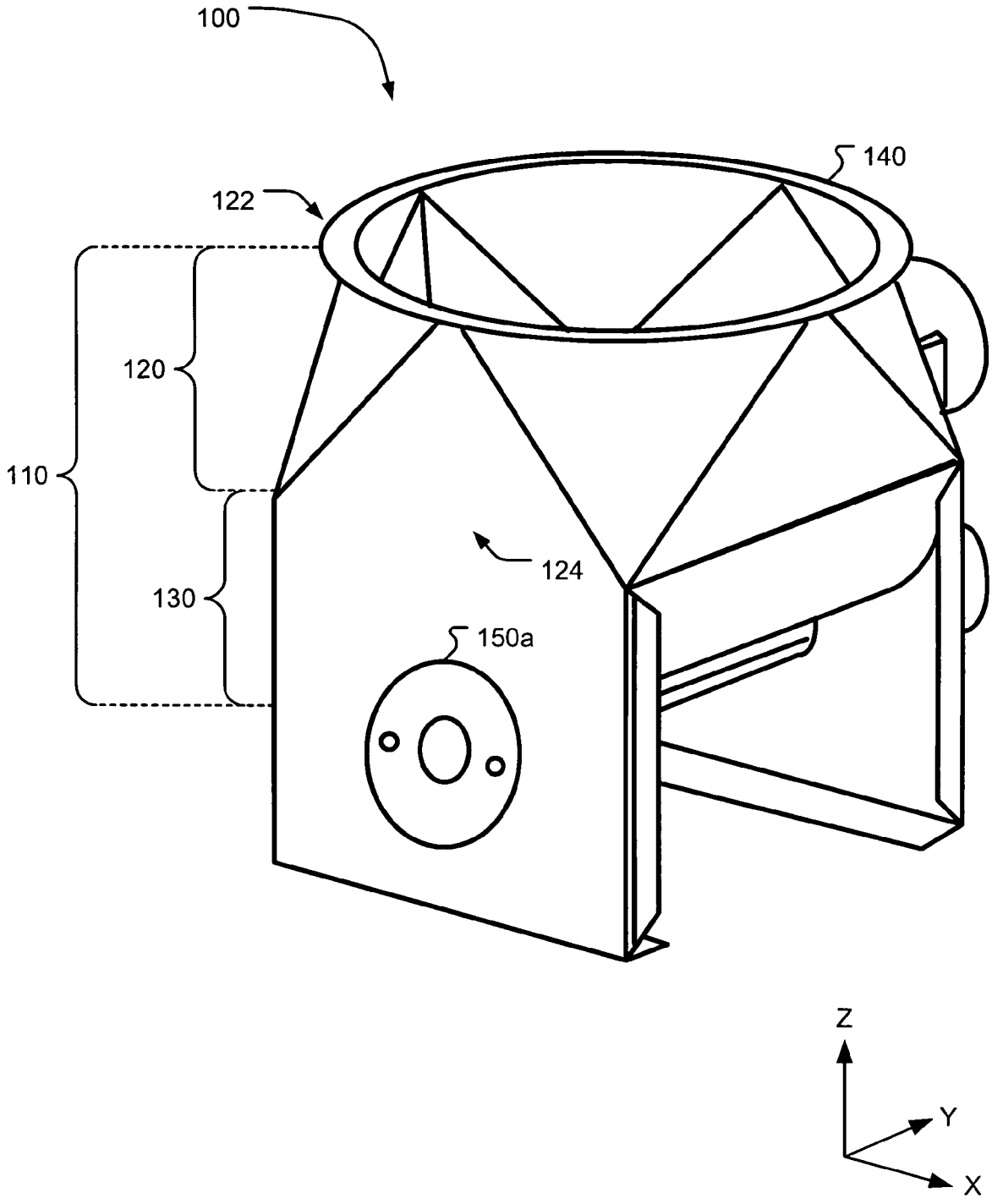
FIG. 1 is a diagram showing a perspective view of a bin having a circular-to-rectangular conduit.

Reference is now made in detail to the description of the embodiments as illustrated in the drawings. While several embodiments are described in connection with these drawings, there is no intent to limit the invention to the embodiment or embodiments disclosed herein. On the contrary, the intent is to cover all alternatives, modifications, and equivalents.

Traditional particulate-matter-delivery systems include trough-shaped bins that are coupled to storage hoppers that have rectangular axial profiles. Unfortunately, the corners resulting from the rectangular axial profile are susceptible to "bridges" or "rat holes" that impede the flow of particulate matter. Others have attempted to reduce the formation of bridges and rat holes in particulate-matter-delivery systems by reducing the number of corners. For example, cylindrical hoppers with circular cross-sectional profiles have been coupled to bowl-shaped bins. Unfortunately, when an auger is threaded through the bottom of a bowl-shaped bin, there is relatively little exposure of the particulate matter to the auger. The reduced exposure to the auger sometimes results in erratic flow of the particulate matter.

In order to remedy these and other problems, a rectangular-to-circular conduit is extended from the trough-shaped feeder to a storage hopper having a circular axial profile. The trough-shaped feeder has a substantially-rectangular feeder opening. The rectangular-to-circular conduit has a circular end and a rectangular end opposite the circular end, with the circular end having a substantially-circular conduit opening. The rectangular end is shaped to engage the substantially-rectangular feeder opening. This type of "circular-to-trough" design reduces the corners at which bridges or rat holes can form. Additionally, the circular-to-trough design provides greater exposure of particulate matter to an auger, thereby providing relatively stable performance of the particulate-matter-delivery system. Several embodiments of circular-to-trough particulate-matter-delivery systems are shown and described with reference to FIGS. 1 through 9.

FIG. 1 is a diagram showing a perspective view of a bin 110 having a circular-to-rectangular conduit 120. For purposes of clarity, Cartesian axes are provided in which the axial-, lateral-, and transverse axes are represented by the Z-axis, the Y-axis, and the X-axis, respectively. As shown in FIG. 1, some embodiments of the system 100 include a bin 110 with two distinct sections: a trough-shaped feeder 130 and a rectangular-to-circular conduit 120 extending from the trough-shaped feeder 130. Depending on the orientation, the rectangular-to-circular conduit 120 is also referred to herein as a circular-to-rectangular conduit 120. Also, for simplicity, the rectangular-to-circular conduit 120 is also referred to herein simply as conduit 120. As shown in FIG. 1, the conduit 120 has a circular end 122 and a rectangular end 124 opposite the circular end 122. The circular end 122 has a substantially-circular opening 140, through which the bin 110 receives particulate matter. The bin 110 further includes a bin outlet 150*a* (also referred to as "outlet 150*a*") that is adapted to expel particulate matter from the bin 110. Greater discussion on the outlet 150*a* is provided with reference to FIG. 7.

As shown in FIG. 1, in some embodiments, the cross-sectional area at the circular end 122 of the conduit 120 is smaller than the cross-sectional area at the rectangular end 124 of the conduit 120. The progressively increasing cross-sectional area from the circular end 122 to the rectangular end 124 reduces bottlenecking, which concomitantly reduces the system's susceptibility to bridging of particulate matter that flows through the bin 110. Stated differently, the shape of the conduit 120 exhibits a reverse angle along the negative-Z axis. The reverse angle, from top (Z) to bottom (−Z) ameliorates potential problems associated with bridge formation or rat hole formation.

Figure 2:
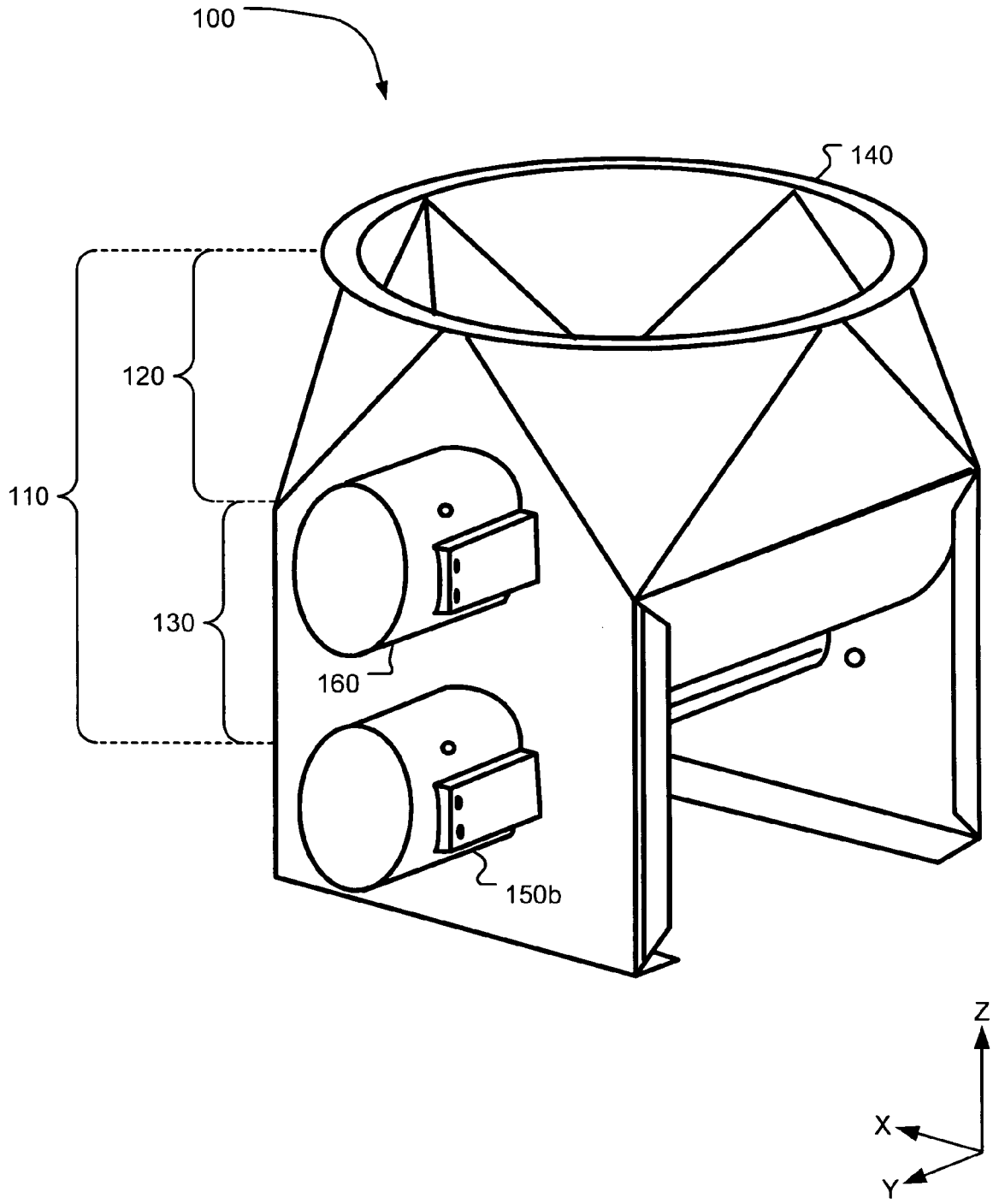
FIG. 2 is a diagram showing a reverse perspective of the bin of FIG. 1.
Figure 7:
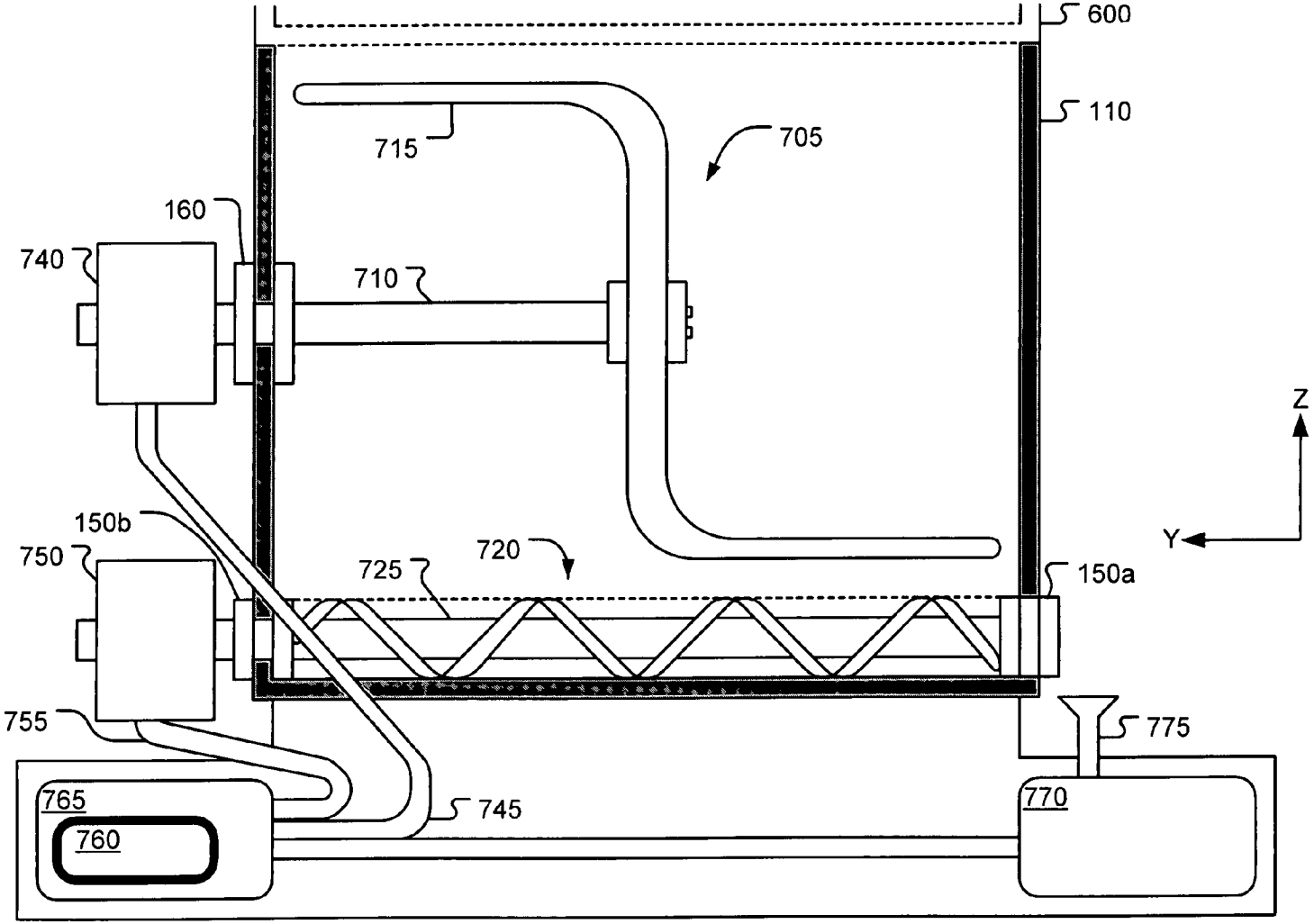
FIG. 7 is a block diagram showing an embodiment of a particulate-matter-delivery system including the bin and storage hopper of FIG. 6.

FIG. 2 is a diagram showing the bin of FIG. 1 from another perspective. As shown in FIG. 2, some embodiments of the particulate-matter-delivery system 100 further include an auger-motor interface 150*b* and an agitator-motor interface 160. The auger-motor interface 150*b* provides a mechanism by which an auger motor 750 (FIG. 7) can be mechanically coupled to an auger 720 (FIG. 7). Similarly, the agitator-motor interface 160 provides a mechanism by which an agitator motor 740 (FIG. 7) can be mechanically coupled to an agitator 705 (FIG. 7). The agitator motor 740, the agitator 705, the auger motor 750, and the auger 720 are discussed in greater detail with reference to FIG. 7. Since the bin 110, the conduit 120, the trough-shaped feeder 130, and the substantially-circular opening 140 are discussed with reference to FIG. 1, further discussion of these components is omitted here.

Figure 3:
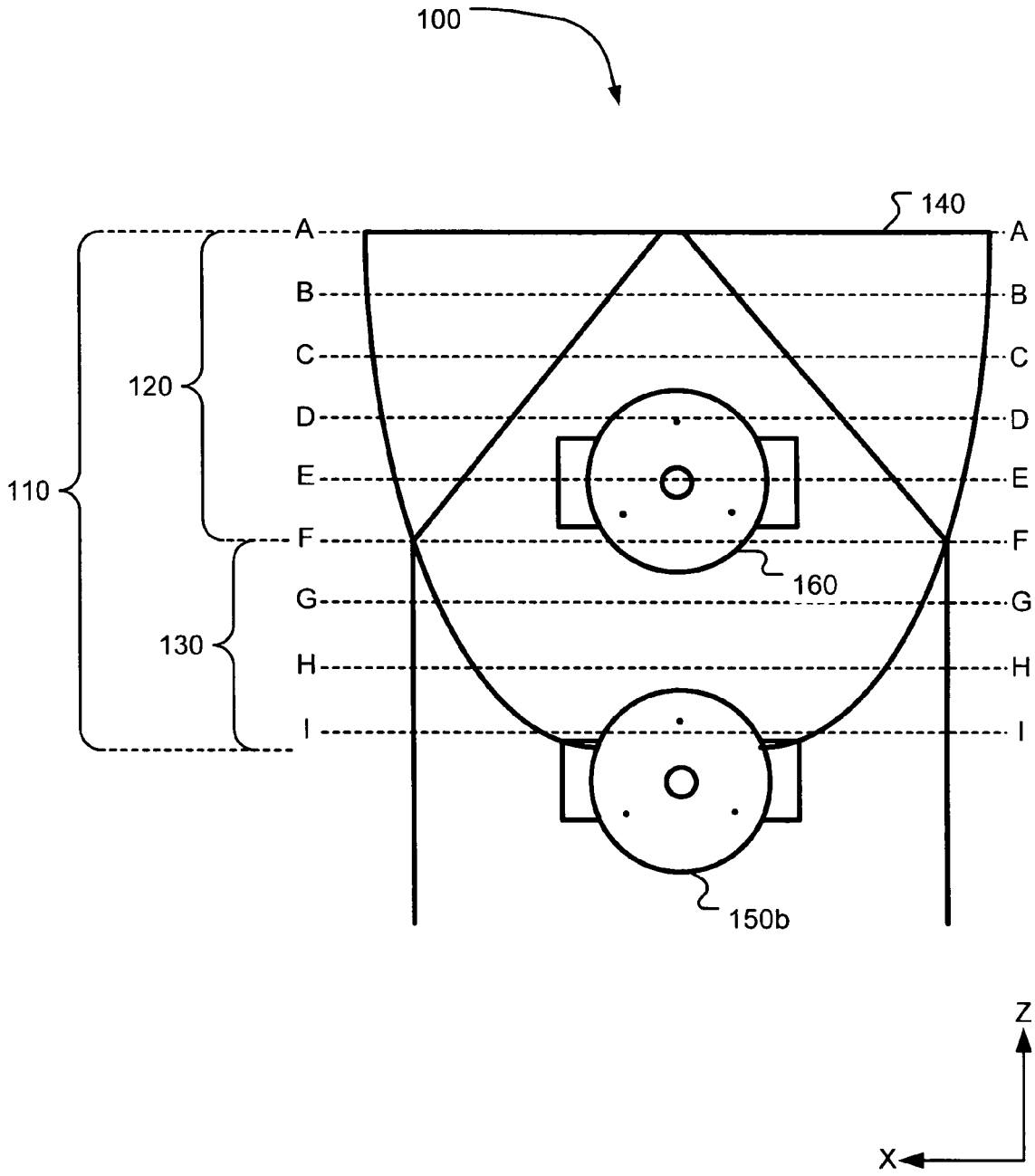
FIG. 3 is a diagram showing a lateral (Y-axis) view of the bin of FIG. 1.

FIG. 3 is a diagram showing a lateral (Y-axis) view of the bin 110 of FIG. 1. Specifically, as shown in FIG. 3, the lateral view shows planar cross-sections associated with the conduit 120 (i.e., cross-sections A—A, B—B, C—C, D—D, E—E). Also, FIG. 3 shows planar cross-sections associated with the trough-shaped feeder 130 (i.e., cross-sections G—G, H—H, and I—I). The planar cross-section F—F defines the interface between the conduit 120 and the trough-shaped feeder 130. The axial profile from these planar cross-sections is shown in greater detail with reference to FIGS. 5A through 5I.

Figure 4:
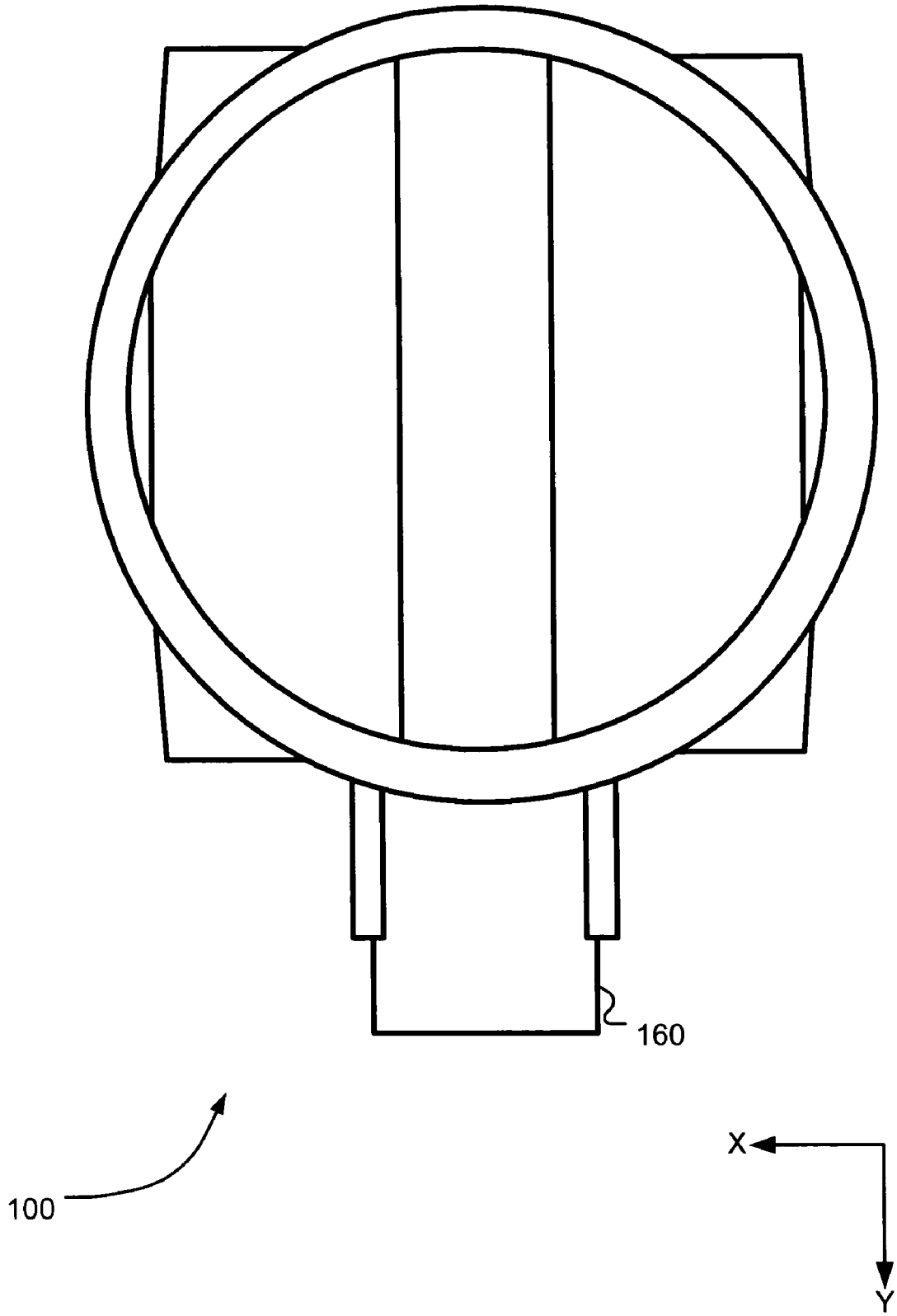
FIG. 4 is a diagram showing an axial (Z-axis) view or top view of the bin of FIG. 1.

FIG. 4 is a diagram showing an axial (Z-axis) view or top view of the bin of FIG. 1. As shown in FIG. 4, the axial projection of the particulate-matter-delivery system 100 appears as a superposition of a substantially-circular cross-section from the top 122 of the conduit 120 and a substantially-rectangular cross-section from the bottom 124 of the conduit 120.

FIGS. 5A through 5I are diagrams showing the circular-to-rectangular transition of the profile of the bin 110 as defined by the planes A—A through I—I, respectively, of FIG. 3. To more clearly illustrate the transition from a substantially-circular axial profile to a substantially-rectangular axial profile, both a substantially-circular profile and a substantially-rectangular profile are shown in broken lines while the actual axial profile of the bin 110 is shown as a solid line.

As shown in FIG. 5A, the conduit 120 has a substantially-circular axial profile at the top 122 of the conduit 120 (at A—A). As seen from FIG. 5B, the substantially-circular axial profile flattens at the sides right below the top 122 of the conduit 120 (at B—B). The sides progressively continue to flatten, as shown in FIGS. 5C through 5E (or C—C through E—E), until the profile at the bottom 124 of the conduit 120 (at F—F) becomes substantially-rectangular, as shown in FIG. 5F. Since the conduit 120 extends from the trough-shaped feeder 130, the top of the trough-shaped feeder 130 shares a similar profile with the bottom 124 of the conduit 120. Progressing downward (in the negative-Z direction), the substantially-rectangular profile of the trough-like feeder 130 become progressively narrower, as shown in FIGS. 5G through 5I (or G—G-through I—I). Thus, as shown in FIGS. 5A through 5I, the bin 110 can be seen as a "circular-to-trough" design.

While a circular-to-trough design is shown in FIGS. 5A through 5I, it should be appreciated that a circular cross-section is a subset of elliptical cross-sections. In that regard, it should be appreciated that elliptical-to-trough designs are also contemplated by this disclosure.

Figure 6:
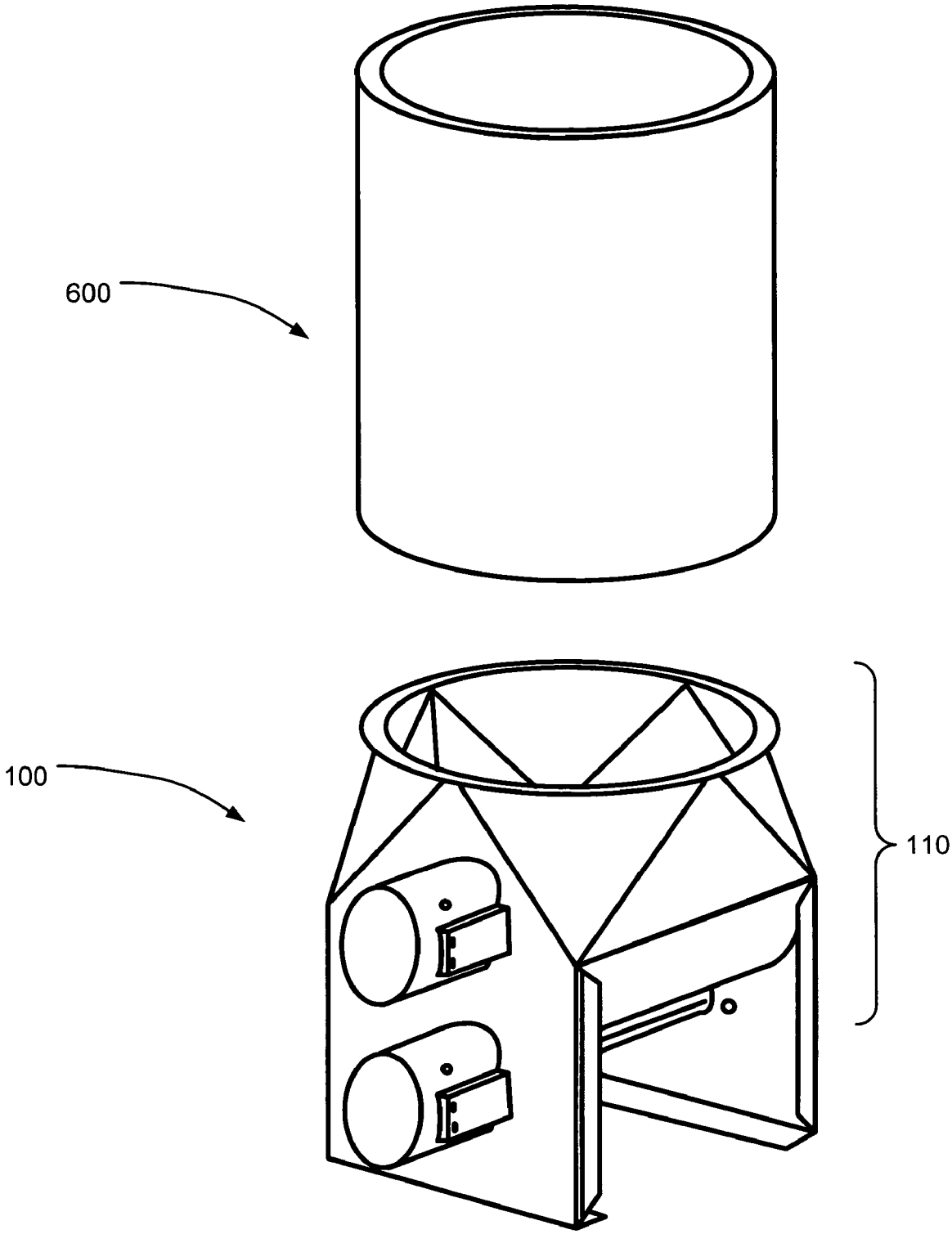
FIG. 6 is a diagram showing the bin of FIGS. 1 through 5I in conjunction with a storage hopper having a circular axial profile.

FIG. 6 is a diagram showing the bin system 100 of FIGS. 1 through 5I in conjunction with a storage hopper 600 having a circular axial profile. As shown in FIG. 6, the storage hopper 600 is shaped as a circular cylinder (i.e., a cylinder having a substantially-circular axial profile). Since the circular end 122 of the conduit 120 has a substantially-circular opening 140, the opening of the substantially-circular storage hopper 600 can be matched in shape and size to the substantially-circular opening 140 of the conduit 120.

Once the size and shape of the interface is matched, particulate matter can be delivered in a near-seamless manner from the storage hopper 600 to the bin system 100.

FIG. 7 is a block diagram showing an embodiment of a particulate-matter-delivery system 100 including the bin 110, as described above. As shown in FIG. 7, in some embodiments, the particulate-matter-delivery system 100 comprises a storage hopper 600 coupled to the bin 110. The storage hopper 600 holds particulate matter (e.g., powder, pellets, etc.) and delivers the particulate matter to the bin 110.

Often, an auger 720 is located within the bin 110, and is secured to the walls of the bin 110 by the auger opening 150*a* and the outlet 150*b*. The auger 720 is configured to rotate about an auger rotational axis 725. As described above, the circular-to-trough design permits increased exposure of the auger 720 with decreased accumulation of particular matter, which, in turn, reduces formation of bridges or rat holes.

The rotation of the auger 720 results in expulsion of the particulate matter from the bin 110. The auger 720 is mechanically coupled to an auger motor 750. Thus, when the auger motor 750 is activated, the auger motor 750 drives the rotation of the auger 720. The auger motor 750 is coupled to a power source 765, which supplies power to the auger motor 750 via an electrical coupling 755.

In some embodiments, the system comprises a sensor 775 that detects the output of the particulate matter from the bin 110. The sensor 775 is coupled to a meter 770, which determines the output rate of the particulate matter from the bin 110. The meter 770, when coupled to the power supply 765, can be used to control the output rate of the particulate matter from the bin 110. Since feedback control mechanisms for controlling output rates are known to those having ordinary skill in the art, further discussion of the feedback control mechanism is omitted here.

A mechanical agitator 705 is located with in the bin 110, and is mechanically coupled to an external agitator motor 740 through an agitator opening 160. In some embodiments, the mechanical agitator 705 comprises one or more blades 715 that interact with the particulate matter during agitation. The mechanical agitator 705 comprises an agitator rotational axis 710. The rotation of the mechanical agitator 705 about the agitator rotational axis 710 results in the mixing of the particulate matter within the bin 110, thereby preventing packing or clumping of the particulate matter. Since the mechanical agitator 705 is mechanically coupled to an agitator motor 740, the agitator motor 740 drives the rotational motion of the blades 715 about the agitator rotational axis 710. Similar to the auger motor 750, the agitator motor 740 is coupled to the power source 765, which supplies power to the agitator motor 740 via an electrical coupling 745. Because the power supply 765 provides power to both the agitator motor 740 and the auger motor 750, it should be appreciated that the power from the power supply 765 can be divided and independently controlled for the agitator motor 740 and the auger motor 750. Since techniques for dividing power and independently delivering power to multiple devices from a single source are known in the art, further discussion of such mechanisms is omitted here.

In some embodiments, the particulate-matter-delivery system includes a hardware controller 760. The hardware controller 760 is coupled to the power source 765 and can be configured to control the delivery of power from the power source 765 to the agitator motor 740. In some embodiments, the hardware controller 760 is configured to intermittently produce an electrical signal. The intermittent production of the electrical signal results in an intermittent delivery of power from the power supply 765 to the agitator motor 740. The intermittent delivery of power results in the agitator motor 740 being driven intermittently. Since the mechanical agitator 705 is mechanically coupled to the agitator motor 740, the intermittent behavior of the agitator motor 740 results in a corresponding intermittent rotation of the mechanical agitator 705 about the agitator rotational axis 710.

In some embodiments, the hardware controller 760 can also be electrically coupled to the meter 770. In this regard, the hardware controller 760 can be configured to deactivate the meter 770 when the agitator motor 740 is activated. Conversely, the hardware controller 760 can be configured to activate the meter 770 when the agitator motor 740 is deactivated. Thus, any vibration generated from the movement of the mechanical agitator 705 is effectively removed during operation of the meter 770. In other words, vibrational artifacts generated by the mechanical agitator 705 are minimized during the measurement of particulate output from the bin 110. In order to maximize the monitoring of the output, the activation of the mechanical agitator 705 can occupy a small portion of the duty cycle. For example, in some embodiments, the period of activation can be twenty percent (20%) of the total operating period while the period of deactivation can be eighty percent (80%) of the total operating period.

The hardware controller 760 can be implemented using conventional timing circuits, such as, for example, phase-locked loops. Since conventional timing circuits are known in the art, further discussion of timing circuits is omitted here. However, it should be appreciated that the intermittent agitation of the particulate matter conserves energy due to the periods of deactivation in which the agitator motor 740 consumes minimal or no power. Also, unlike continuous-agitation systems or variable-rate-agitation systems, the deactivation of the mechanical agitator for a finite time interval facilitates the reduction of adverse effects (e.g., vibration or other artifacts) on other portions of the system.

Figure 8:
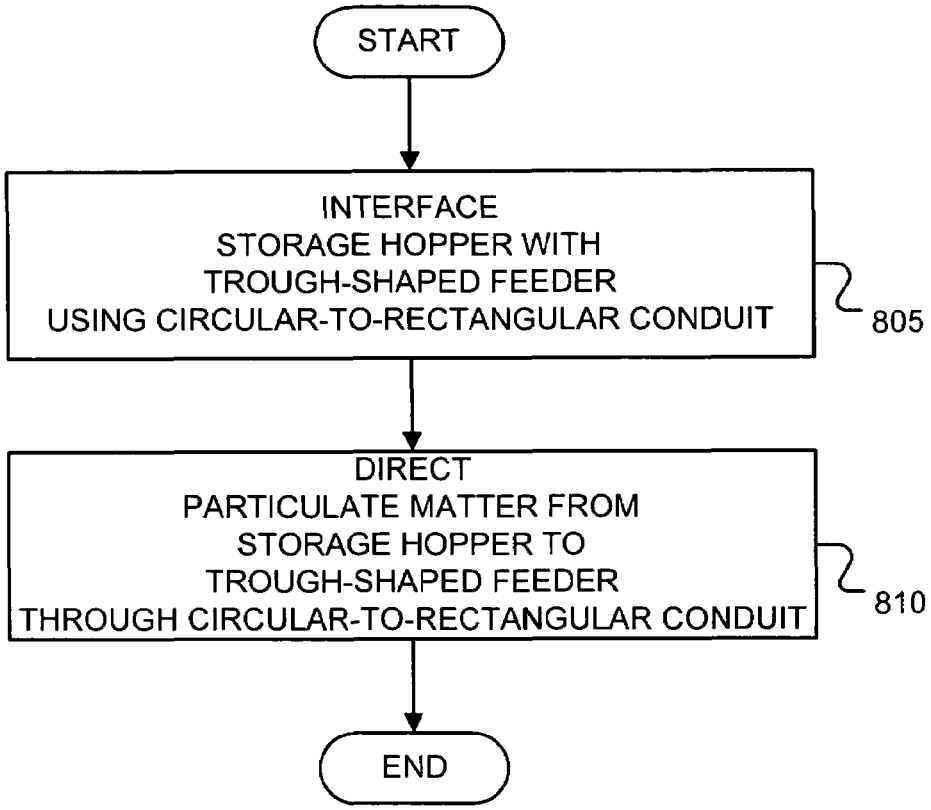
FIG. 8 is a flowchart showing an embodiment of a method for reducing particulate matter buildup in a particulate-matter-delivery system.

FIG. 8 is a flowchart showing an embodiment of a method for reducing particulate matter buildup in a particulate-matter-delivery system. As shown in FIG. 8, some embodiments of the process begin by interfacing (805) a storage hopper with a trough-shaped feeder using a circular-to-rectangular conduit. Thereafter, particulate matter is directed (810) from the storage hopper to the trough-shaped feeder through the circular-to-rectangular conduit.

In some embodiments, the circular-to-rectangular conduit has a substantially-circular opening at the circular end of the conduit, and a substantially-rectangular opening at the rectangular end of the conduit. In those embodiments, the area of the substantially-rectangular opening is greater than the area of the substantially-circular opening, thereby further reducing the conduit's susceptibility to rat holes and bridges.

Figure 9:
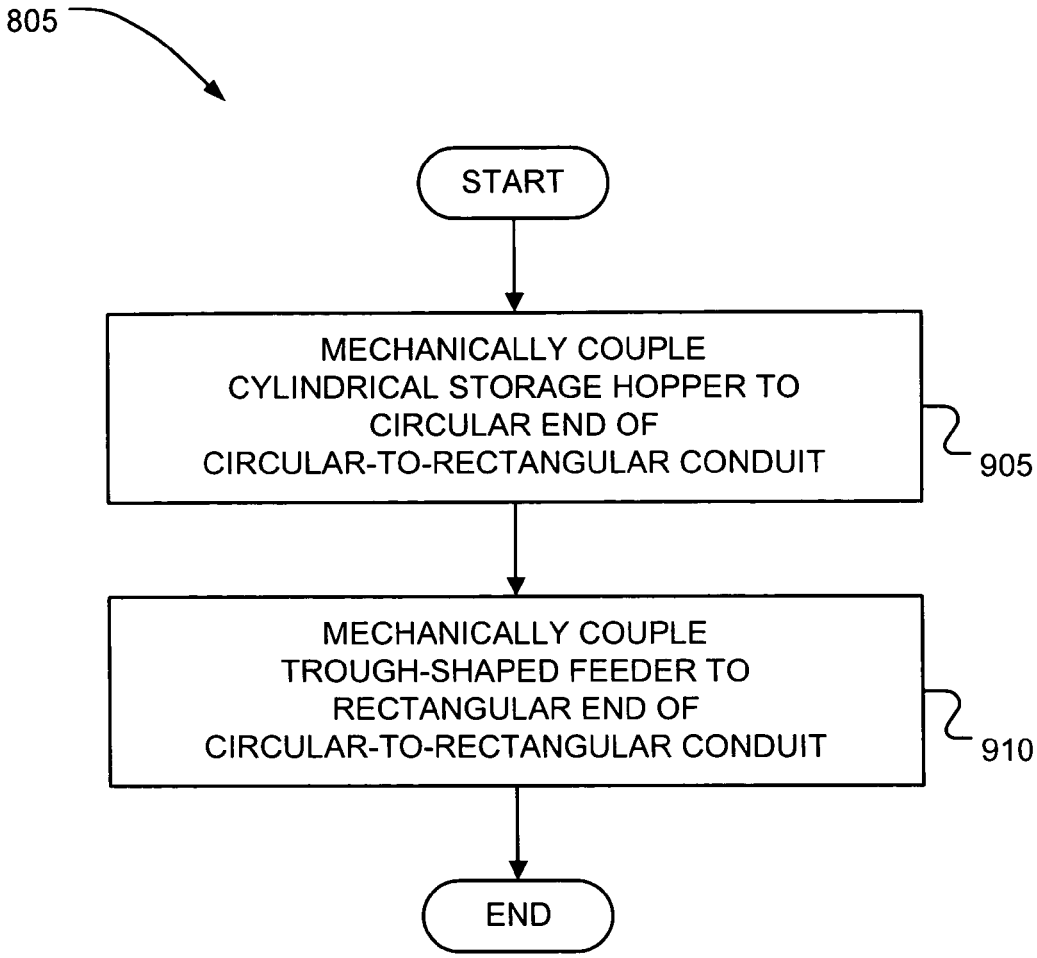
FIG. 9 is a flowchart showing another embodiment of a method for reducing particulate matter buildup in a particulate-matter-delivery system.

In yet other embodiments, as shown in FIG. 9, the step of interfacing (805) the storage hopper with the trough-shaped feeder can be seen as comprising the steps of mechanically coupling (905) the storage hopper to the circular end of the circular-to-rectangular conduit, and, also, mechanically coupling (910) the trough-shaped feeder to the rectangular end of the circular-to-rectangular conduit.

Although exemplary embodiments have been shown and described, it will be clear to those of ordinary skill in the art that a number of changes, modifications, or alterations to the invention as described can be made. All such changes, modifications, and alterations should therefore be seen as within the scope of the disclosure.

What is claimed is:

1. A particulate-matter-delivery system comprising:

(IA) a cylindrical storage hopper having:

(IA1) a substantially-circular profile along the cylindrical axis; and (IA2) a substantially-circular hopper opening adapted to expel particulate matter from the cylindrical storage hopper;

(IB) a bin having:

(IB1) a bin outlet;

(IB2) a trough-shaped feeder having a substantially-rectangular top opening, and a substantially-rectangular bottom opening coupled to the bin outlet; and (IB3) a transitional section having:

(IB3a) a substantially-circular opening coupled to the substantially-circular hopper opening;

(IB3b) a circular-to-rectangular conduit interposed between the substantially-circular hopper opening and the substantially-rectangular top opening of the trough-shaped feeder;

(IC) an auger having an auger rotational axis, the auger being located within the bin, the auger being operatively coupled to the bin outlet, the auger being configured to rotate about the auger rotational axis; and (ID) an auger motor coupled to the auger, the auger motor being configured to rotate the auger about the auger rotational axis when the motor is activated, the rotating of the auger resulting in expulsion of the particulate matter through the bin outlet.

2. The system of claim 1, further comprising:

an agitator having an agitator rotational axis, the agitator being located within the bin; and an agitator motor coupled to the agitator, the agitator motor being configured to rotate the agitator about the agitator rotational axis, the rotating of the agitator resulting in agitation of the particulate matter in the bin.

3. The system of claim 1 wherein the area of the substantially-rectangular top opening is greater than the area of the substantially-circular bin opening.

4. A particulate-matter-delivery system comprising:

a trough-shaped feeder with a rectangular feeder opening and a rectangular feeder exit;

a trough-shaped outlet section mated to the rectangular feeder exit, and having an outlet opening; and a rectangular-to-circular conduit having a circular end and a rectangular end, the rectangular-to-circular conduit extending from the rectangular opening of the trough-shaped feeder, the circular end having a circular conduit opening, the rectangular end having a rectangular opening mated to the rectangular feeder opening.

5. The system of claim 4, further comprising:

an auger located within the trough-shaped outlet section, the auger being operatively coupled to the outlet opening, the auger having an auger rotational axis; and an auger motor coupled to the auger, the auger motor being configured to rotate the auger about the auger rotational axis when the motor is activated, the rotating of the auger resulting in expulsion of the particulate matter through the outlet opening.

6. The system of claim 4, the rectangular feeder exit having a smaller cross-sectional area than a cross-sectional area of the rectangular feed opening.

7. The system of claim 4, further comprising:

an agitator having an agitator rotational axis, the agitator being located within the trough-shaped feeder; and an agitator motor coupled to the agitator, the agitator motor being configured to rotate the agitator about the agitator rotational axis, the rotating of the agitator resulting in agitation of the particulate matter in the trough-shaped feeder.

8. A particulate-matter-delivery system comprising:

a trough-shaped feeder with a rectangular feeder opening; and a rectangular-to-circular conduit having a circular end and a rectangular end, the rectangular-to-circular conduit extending from the rectangular opening of the trough-shaped feeder, the circular end having a circular conduit opening, the rectangular end having a rectangular opening mated to the rectangular feeder opening, wherein the area of the rectangular feeder opening is greater than the area of the circular conduit opening.

9. The system of claim 8, further comprising a storage hopper having a circular hopper opening, the circular hopper opening being coupled to the circular conduit opening.

10. The system of claim 8, further comprising:

an auger located within the trough-shaped feeder, the auger having an auger rotational axis; and an auger motor coupled to the auger, the auger motor being configured to rotate the auger about the auger rotational axis when the motor is activated, the rotating of the auger resulting in expulsion of the particulate matter from the trough-shaped feeder.

11. The system of claim 8 further comprising:

an agitator having an agitator rotational axis, the agitator being located within the trough-shaped feeder; and an agitator motor coupled to the agitator, the agitator motor being configured to rotate the agitator about the agitator rotational axis, the rotating of the agitator resulting in agitation of the particulate matter in the trough-shaped feeder.

12. A particulate-matter-delivery system comprising:

a trough-shaped feeder with a substantially-rectangular feeder opening; and a rectangular-to-elliptical conduit having an elliptical end and a rectangular end, the rectangular-to-elliptical conduit extending from the substantially-rectangular opening of the trough-shaped feeder, the elliptical end having a substantially-elliptical conduit opening, the rectangular end having a substantially-rectangular conduit opening, the substantially-rectangular conduit opening being mated to the substantially-rectangular feeder opening.

13. The system of claim 13, wherein the area of the substantially-rectangular feeder opening is greater than the area of the substantially-elliptical conduit opening.

14. The system of claim 13, wherein the cross-sectional area of the rectangular-to-elliptical conduit progressively decreases from the rectangular conduit end to the elliptical conduit end.

15. The system of claim 12, further comprising a storage hopper having a substantially-elliptical hopper opening, the substantially-elliptical hopper opening being coupled to the substantially-elliptical conduit opening.

16. The system of claim 12, wherein the trough-shaped feeder comprises means for expelling particulate matter.

17. The system of claim 12, wherein the trough-shaped feeder comprises an outlet adapted to expel particulate matter.

18. The system of claim 17, wherein the combination of the trough-shaped feeder and the rectangular-to-elliptical conduit defines a bin.

19. The system of claim 18, further comprising:

an agitator located within the bin, the agitator having an agitator rotational axis; and an agitator motor coupled to the agitator, the agitator motor being configured to rotate the agitator about the agitator rotational axis, the rotating of the agitator resulting in agitation of particulate matter in the bin.

20. A method for reducing bridging in particulate-matter-delivery systems, the method comprising the steps of:

interfacing a storage hopper with a trough-shaped feeder using a circular-to-rectangular conduit having a circular opening at one end for interfacing the storage hopper and a rectangular opening at an opposite end for interfacing the trough-shaped feeder, the area of the rectangular opening being greater than the area of the circular opening; and directing particulate matter from the storage hopper to the trough-shaped feeder through the circular-to-rectangular conduit.

21. A method for reducing bridging in particulate-matter-delivery systems, the method comprising the steps of:

interfacing a storage hopper with a trough-shaped feeder using an elliptical-to-rectangular conduit; and directing particulate matter from the storage hopper to the trough-shaped feeder through the elliptical-to-rectangular conduit.

22. The method of claim 21, wherein the interfacing step comprises the step of:

providing an elliptical-to-rectangular conduit having a substantially-elliptical opening at the elliptical end of the conduit and a substantially-rectangular opening at the rectangular end of the conduit, the area of the substantially-rectangular opening being greater than the area of the substantially-elliptical opening.

23. The method of claim 21, wherein the interfacing step comprises the steps of:

coupling the storage hopper to the elliptical end of the elliptical-to-rectangular conduit; and coupling the trough-shaped feeder to the rectangular end of the elliptical-to-rectangular conduit.

24. A method for reducing bridging in particulate-matter-delivery systems, the method comprising the steps of:

coupling a cylindrical storage hopper to a elliptical end of the elliptical-to-rectangular conduit, the cylindrical storage hopper having a substantially-elliptical axial profile, the cylindrical storage hopper further having a substantially-elliptical hopper opening, the elliptical end of the elliptical-to-rectangular conduit having a substantially-elliptical conduit opening, the substantially-elliptical conduit opening being substantially similar in shape to the substantially-elliptical hopper opening, the substantially-elliptical conduit opening being substantially similar in size to the substantially-elliptical hopper opening; and coupling a trough-shaped feeder to a rectangular end of the elliptical-to-rectangular conduit, the trough-shaped feeder having a substantially-rectangular feeder opening, the rectangular end of the elliptical-to-rectangular conduit having a substantially-rectangular conduit opening, the substantially-rectangular conduit opening being substantially similar in shape to the substantially-rectangular feeder opening, the substantially-rectangular conduit opening being substantially similar in size to the substantially-rectangular feeder opening.

25. The method of claim 24, further comprising the step of:

directing particulate matter from the storage hopper to the trough-shaped feeder through the elliptical-to-rectangular conduit.

26. A particulate-matter-delivery system comprising:

a trough-shaped feeder with a rectangular feeder opening; and a rectangular-to-circular conduit having a circular end and a rectangular end, the rectangular-to-circular conduit extending from the rectangular opening of the trough-shaped feeder, the circular end having a circular conduit opening, the rectangular end having a rectangular opening mated to the rectangular feeder opening, wherein the trough-shaped feeder has a pair of opposed, parallel sides.

27. A particulate-matter-delivery system comprising:

a trough-shaped feeder with a rectangular feeder opening; and a rectangular-to-circular conduit having a circular end and a rectangular end, the rectangular-to-circular conduit extending from the rectangular opening of the trough-shaped feeder, the circular end having a circular conduit opening, the rectangular end having a rectangular opening mated to the rectangular feeder opening, the rectangular-to-circular conduit having sides that diverge from each other as they move away from the circular end towards the rectangular end.

28. The system of claim 27, wherein the trough-shaped feeder has a pair of opposed, parallel sides.

* * * * *